US009528672B2

(12) United States Patent
Brendle

(10) Patent No.: US 9,528,672 B2
(45) Date of Patent: Dec. 27, 2016

(54) LIGHT MODULE OF A LIGHTING DEVICE IN A MOTOR VEHICLE

(71) Applicant: Automotive Lighting Reutlingen GmbH, Reutlingen (DE)

(72) Inventor: Matthias Brendle, Tuebingen (DE)

(73) Assignee: Automotive Lighting Reutlingen GmbH, Reutlingen (DE)

( * ) Notice: Subject to any disclaimer, the term of this patent is extended or adjusted under 35 U.S.C. 154(b) by 0 days.

(21) Appl. No.: 14/230,714

(22) Filed: Mar. 31, 2014

(65) Prior Publication Data

US 2014/0307458 A1 Oct. 16, 2014

(30) Foreign Application Priority Data

Apr. 11, 2013 (DE) ..... 10 2013 206 489

(51) Int. Cl.
*F21S 8/10* (2006.01)

(52) U.S. Cl.
CPC ..... *F21S 48/1154* (2013.01); *F21S 48/1159* (2013.01); *F21S 48/1241* (2013.01); *F21S 48/137* (2013.01); *F21S 48/1388* (2013.01); *F21S 48/145* (2013.01);
(Continued)

(58) Field of Classification Search
CPC ..... F21S 48/1154
See application file for complete search history.

(56) References Cited

U.S. PATENT DOCUMENTS 4,862,329 A * 8/1989 Nino ..... F21S 48/145 362/214
9,039,259 B2 * 5/2015 Albou ..... B60Q 1/0041 362/296.01
9,157,595 B2 * 10/2015 Hager ..... F21S 48/115
(Continued)

FOREIGN PATENT DOCUMENTS

DE 102009008631 A1 8/2001
DE 10 2009 008 631 A1 8/2010
(Continued)

OTHER PUBLICATIONS

Jan. 20, 2014 Examination Report for DE 10 2013 206 489.6.
(Continued)

*Primary Examiner* — Renee Chavez
*Assistant Examiner* — Eric T Eide
(74) *Attorney, Agent, or Firm* — Howard & Howard Attorneys PLLC

(57) ABSTRACT

The invention relates to a light module of a lighting device in a motor vehicle. The light module includes at least two light sources for emitting light and at least two primary optics assigned to the light sources for focusing the light. Further, the light module includes a common secondary optics for projecting the light beams onto a roadway and for producing a resulting overall light distribution of the light module. At least one of the light sources is configured for creating a main light distribution and at least another one of the light sources is configured for creating a secondary light distribution. The primary optics, which is assigned to the light source for creating a secondary light distribution, is arranged in several parts whereby a first partial primary optics is arranged next the primary optics which is assigned to the light source for creating the main light distribution.

13 Claims, 12 Drawing Sheets

(52) U.S. Cl.
CPC ..... *F21S 48/1747* (2013.01); *F21S 48/328* (2013.01); *F21S 48/1258* (2013.01)

(56) References Cited

U.S. PATENT DOCUMENTS

| | | | | |
|---|---|---|---|---|
| 2006/0120094 | A1* | 6/2006 | Tsukamoto et al. | 362/518 |
| 2006/0285341 | A1* | 12/2006 | Yatsuda et al. | 362/464 |
| 2008/0112180 | A1* | 5/2008 | Okada | 362/518 |
| 2008/0316763 | A1* | 12/2008 | Albou | 362/538 |
| 2009/0073712 | A1* | 3/2009 | Yamamura et al. | 362/519 |
| 2009/0207625 | A1 | 8/2009 | Konishi | |
| 2010/0226142 | A1 | 9/2010 | Brendle et al. | |
| 2013/0194816 | A1* | 8/2013 | Hager | F21S 48/115 362/487 |

FOREIGN PATENT DOCUMENTS

| | | | |
|---|---|---|---|
| EP | 1935715 | A1 | 6/2008 |
| EP | 2 184 532 | A2 | 11/2009 |
| EP | 2119957 | A1 | 11/2009 |
| EP | 2184532 | A2 | 5/2010 |
| EP | 2492580 | A2 | 8/2012 |
| JP | 2007324001 | A | 12/2007 |

OTHER PUBLICATIONS

Communication mailed Aug. 5, 2016 from the European Patent Office enclosing the European Search Report dated Jul. 26, 2016 for European Patent Application No. 14160768.9.

* cited by examiner

LIGHT MODULE OF A LIGHTING DEVICE IN A MOTOR VEHICLE

CROSS-REFERENCE TO RELATED APPLICATION

This application is based upon and claim priority to German Patent Application 10 2013 206 489.6 filed on Apr. 11, 2013.

BACKGROUND OF INVENTION

1. Field of Invention

The present invention relates to a light module of a lighting device in a motor vehicle.

2. Description of Related Art

Various approaches for accomplishing so-called matrix high beam light modules are known in the prior art. A matrix high beam light module includes a light source with several semiconductor light sources (LEDs) which are arranged in rows and/or columns, where several LEDs are activated in order to produce the desired high beam light distribution. The individual LEDs can be activated individually, such that individual LEDs can be selectively deactivated, in order to specifically fade out certain areas of the resulting high beam light distribution. In this way, it is possible to cut out certain areas of the high beam light distribution, where other vehicles are located. This enables a particularly good illumination of the road way area in front of the motor vehicle with the high beam light distribution, and also prevents blinding other vehicles driving ahead of the vehicle and/or approaching. In order to create matrix high beam light modules, systems with an actual intermediate image are generally used, in which several directly joined images of the LEDs are produced by the primary optics, which are then reproduced on the roadway in front of the motor vehicle in order to produce the resulting high beam light distribution with a subsequent secondary optics within the optical path. Due to their projecting characteristics of the secondary optics, such systems are also called projection systems.

Suitable secondary optics are reflectors as well as lenses or lens systems. A secondary optics projects one or more light source images from an actual intermediate image layer onto the roadway in front of the motor vehicle in order to produce the desired light distribution of the light module. Suitable primary optics are, for example, converging lenses, conical light conductors, disc-shaped light conductors, or reflectors which can be arranged individually or in several rows and/or columns, array or matrix like, next to and/or above each other. When matrix semiconductor light sources are used, the primary optics generally includes lenses, light conductors, or reflectors which are combined to arrays. The light output area of the primary optics, or the light output areas of the individual primary optical elements of an optical array, is or are situated approximately within the so-called Petzval field curvature of the secondary optics, so that the individual light source images produced by the primary optical elements can be clearly delimited from each other with the help of refraction and/or reflection. The Petzval field curvature can be described as an area, where the points are reproduced as even as possible and in a desired way onto a distant image area in driving direction or in the direction of the beam with the secondary optics. Here, the object points can also be displayed as lines or rectangles or the like, instead of as points.

Depending on the type of primary optics that is being used in the prior art with this the light distribution, the intermediate image can only be minimally influenced in its shape and luminance distribution. Particularly arrays of converging lenses, whose light output area is arranged directly inside the Petzval field curvature of the secondary optics, produce light distributions with fairly uniform luminance. In such a case, the further light shaping (for example, the vertical shaping of the light distribution) has to be performed with a secondary optics, which features a distinctive astigmatism. Here, all light distributions in the intermediate image will be distorted in the same way by the subsequent secondary optics.

Most of the matrix light distributions include several equally wide strip-shaped light distributions in the center. In addition, it is meaningful to supplement these central light distributions with one or several wide light distributions at least towards the sides, which fade out softly towards the road side. If the particularly simple and preferred lens arrays or reflector arrays are used as primary optics, it is not automatically possible to produce one or more wide light distributions, which fade out softly towards the road side within the intermediate image and with which the described road side illumination can be created, directly adjacent to the fairly evenly illuminated light distributions in the center. In this case, the lens of the primary optics, which produces the intermediate image of the road side illumination, along with its assigned light source, would have to placed far behind (opposite to the light beam direction) the other light sources and lenses, which create an intermediate light distribution in the center of the matrix light distribution. With this, it would no longer be possible to arrange the light sources for the two light distributions (in the center on the one hand, and at the road side on the other hand) in one layer, preferably on one common circuit board, which significantly increases the engineering effort and the production costs of the light module. Furthermore, the repositioning of the light source(s) for the road side illumination to the back has an adverse effect on the construction length of the light module.

From US 2006/0120094 A1, a projection system for a lighting device in a motor vehicle is known, in which a low beam light distribution with a mainly horizontal cut-off line is supplemented by a partial high beam light distribution which illuminates an area above the cut-off line. The resulting high beam light distribution of the overall system is produced with an overlapping of the low beam light distribution and the partial high beam light distribution. The partial high beam light distribution is produced with the help of a light source and a concave mirror in an immediate image layer of the projection system. The high beam path is then deflected with a passive reflector through the secondary optics, which is designed as a projection lens whereby it is projected onto the roadway in front of the motor vehicle.

SUMMARY OF THE INVENTION

The present invention has the objective to develop and improve a light module of the previously mentioned type in such a way that one or more primary optics in the intermediate layer can produce an additional secondary light distribution with a wider side expansion and a dynamic course of the luminance, in particular a luminance decrease towards the edges of the resulting overall light distribution, and further an overall light distribution of the light module which is as homogenous as possible in particular in the transition areas between the individual light distributions.

In order to accomplish this task based on the light module discussed above, it is suggested that at least one light source is configured to produce light to create a main light distribution, at least another light source is configured to create a secondary light distribution, and that the primary optics, assigned to at least one of the light sources for producing light for the secondary light distribution, is arranged in several parts, wherein at least one first partial primary optics is arranged next to at least one of the primary optics assigned to a light source for producing light for the main light distribution.

The resulting overall light distribution of the light module is accomplished with an overlapping or supplementation of the main light distribution and the secondary light distribution. Here, the secondary optics may project images of the at least one light source for producing light for the secondary light distribution onto the roadway in front of the motor vehicle, which is equipped with the light module. Further, the secondary optics may project intermediate light distributions, which are produced on the light output areas of the primary optical elements and which are not images of light sources for producing light for the main light distribution, onto the roadway of the motor vehicle. Thus, the secondary optics produces the illuminated light output area onto the roadway. The light for the main light distribution serves for the illumination of a center of the resulting overall light distribution. Using the example of a high beam light distribution, this light could be used to produce a high beam spot light. The light for the secondary light distribution serves for the illumination of at least one side area of the overall light distribution. Using the example the high beam, the light could be used to illuminate side areas of a fairly widely-spread basic light distribution. In this example, both light distributions together form an optimized overall light distribution in the shape of a high beam light.

In the light module, the primary optics associated with the light source for producing the light for the secondary light distribution is designed in such a way, that it creates an image of the light source in the intermediate image layer of the light module. The primary optics associated with the light source for producing the light for the main light distribution is designed in such a way that it does not create an image of the light source in the intermediate image layer of the light module, but rather a mere illuminated light output area of the primary optics. The secondary optics projects the images of the light source for the secondary light distribution onto the roadway in front of the motor vehicle and reproduces the illuminated light output areas for the main light distribution on the roadway in front of the vehicle.

In this way, it is possible that an additional secondary light distribution with a large expansion and a dynamic course of the luminance, in particular with a decrease of the luminance towards the edge of the resulting overall light distribution, can be achieved independently from the configuration of the primary optics assigned to the light source for producing the light for the main light distribution. Thereby, the intermediate image of the secondary light distribution is to be connected, if possible without any gap, to the intermediate light distribution of the main light distribution, which is produced by the other primary optics. Furthermore, the primary optics for producing the secondary light distribution is designed in such a way that the light source for the main light distribution, as well as the light source for the secondary light distribution, can be arranged in one layer, in particular on one common circuit board. Despite the fact that only one light source is mentioned, the light source for producing the main light distribution as well as the light source for producing the secondary light distribution can include several light emitters, for example, several semiconductor light sources, in particular LEDs. The light emitters of one light source can be arranged in several columns and/or rows like in a matrix, and form a light source array.

In one embodiment, the main light distribution includes several strip-shaped partial light distributions expanding in basically vertical direction. The strip-shaped partial light distributions of the main light distribution may be designed in the same way regarding their expansion and luminance distribution. The secondary light distribution may serve for illuminating an outer border region of the overall light distribution of the light module for improving the side illumination. The secondary light distribution, in particular, includes at least one side illumination which connects to a central main light distribution on one side. It is possible to arrange for one or more side illumination areas on one or both sides of the main light distribution. The side illumination does not feature the strip-shaped divisions may be wider than a single strip of the strip-shaped partial light distribution. Further, the side illumination features an advantageous decrease of luminance towards the edge of the main light distribution.

The primary optics for the secondary light distribution is designed in several parts, wherein the individual partial primary optics of the overall primary optics can be designed in any desired way. The primary optics may include a passive reflector as a first partial primary optics, and a concave mirror as a second partial primary optics. The light sent out from the light source for the secondary light distribution reaches the concave mirror, is focused there, and is redirected into the direction of the passive mirror where an image of the light source is created. The passive mirror redirects the image to the secondary optics, which projects it onto the roadway in front of the motor vehicle. The multi-part embodiment of the primary optics for the secondary light distribution results in additional advantageous degrees of freedom regarding the arrangement and alignment of the light source for the secondary light distribution as well as the arrangement and configuration of the produced light source image created with the primary optics for the secondary light distribution in the intermediate image layer of the light module. This, in turn, allows for the arrangement of the light source for the secondary light distribution in one common layer, preferably on a common circuit board, along with the at least one light source for the main light distribution. Furthermore, it is possible to achieve a desired resulting overall light distribution of the light module with relatively little effort with simplified variations of the optical characteristics of the partial primary optics, in particular a desired secondary light distribution with a wide horizontal and/or vertical expansion and a dynamic course of the luminance, particularly with a decrease of the luminance towards the outer border.

In arranging a first part of the primary optics of the secondary light distribution (for example, the passive mirror) in the immediate vicinity of the primary optics for the main light distribution or of the intermediate light distribution(s) that is or are produced by it, it is possible that the intermediate image of the secondary light distribution connects to the intermediate light distributions on the light output areas of the primary optics for the main light distribution if possible without any gap, and thus to produce a particularly homogenously illuminated resulting overall light distribution of the light module, in particular in the transition areas between the individual partial light distributions as well as between the main- and secondary light distributions. In this way, there are no dark areas, shadows, lines, or the like to be found in the transitions between the light distributions. The first part of the primary optics (for example, the passive mirror) may be arranged in the Petval field curvature of the secondary optics and connected directly to the primary optics for the main light distribution or to their light output areas. The other part of the primary optics of the secondary light distribution (for example, the concave mirror) is arranged between the secondary optics of the light module and its Petzval field curvature. The concave mirror can at least partly feature an elliptical profile.

The secondary optics may be focused onto the light output areas of the primary optics or onto a centroid of this area. In one embodiment, the secondary optics is focused onto the light output areas of the primary optics, which is aligned towards the light source for the main light distribution or onto its centroid. The primary optics for the main light distribution may be arranged as an array of converging lenses. The light output areas of the individual lenses are illuminated during operation of the light module, whereas no light source images are generated on these output areas. The illuminated areas are reproduced on the roadway with the secondary optics. The overall light distribution produced by the light module according to the invention is thus created with the projection of the light source images (of the light source for the secondary light distribution), and with the reproduction of the illuminated light output areas (of the primary optics, which is assigned to the light sources for the main light distribution). The combination of these two kinds of images in the resulting overall light distribution allows for a homogenously illuminated overall light distribution in the center, whose border areas feature a desired width and a desired dynamic course of the luminance.

Among other things, the light module of the present invention has the following advantages: the concave mirror offers extensive possibilities for shaping the light beam (for example, with the form and alignment of the concave mirror) so that the course of the luminance of the intermediate image (on the passive mirror) can be shaped to a very large degree, which allows for a high flexibility in the configuration of the secondary light distribution; the concave mirror further offers great freedom regarding the relative position of the light source for the secondary light distribution, and the light distribution that is produced by it (the intermediate image). In this way, it is possible to arrange and interconnect all light sources of the light module cost efficiently in one common layer, in particular on one common circuit board; the concave mirror automatically limits the size of the secondary light distribution such that if the concave mirror is physically connected to the primary optics for the main light distribution or to the light output area of this primary optics directly and completely, and if the entire mirror area of the passive mirror is illuminated (and the entire reflected light is subsequently directed through the secondary optics), then it is automatic that the light distributions produced by the secondary optics connect directly and completely to the main light distribution as well, wherein t the shape, and in particular the measurements and course of the outer circumference of the deflection area, thus define the size and shape of the intermediate image that is to be produced and therefore the design of the secondary light distribution or of a portion of it; the optical system for producing the intermediate image (light source image) for the secondary light distribution does not increase the construction length of the light module according to the invention.

BRIEF DESCRIPTION OF THE DRAWINGS

Further characteristics and advantages of the present invention will be further explained in the following with reference to the figures. The characteristics and advantages, which are depicted and further explained in the figures, can be combined with each other in any possible way, without this being specifically shown in the figures or explained in the following descriptions. It is depicted.

DETAILED DESCRIPTION OF THE INVENTION

The present invention relates to a light module for use in a lighting device of a motor vehicle, in particular in a head light of a motor vehicle. But the light module can also be used in any light of a motor vehicle, such as a day time running light, a fog light or similar. The lighting device includes housing which may be made out of plastic and into which the light module is built. The light module can be arranged into the housing of the lighting device in such a way that it is solidly fixed or movable, in particular around a vertical and/or horizontal swivel axis. The housing features a light aperture which is covered by a transparent cover screen, through which the light, which is produced by the light module, can emit and reach onto the roadway in front of the motor vehicle. The cover screen may be of a plastic material and may be arranged with at least sectional optical diffuser elements (a so-called diffuser lens) or without any such diffuser elements (a so-called clear screen). The embodiment of such a lighting device in a motor vehicle is well known from the prior art and is thus not further depicted in the figures and will not be further explained.

Figure 1:
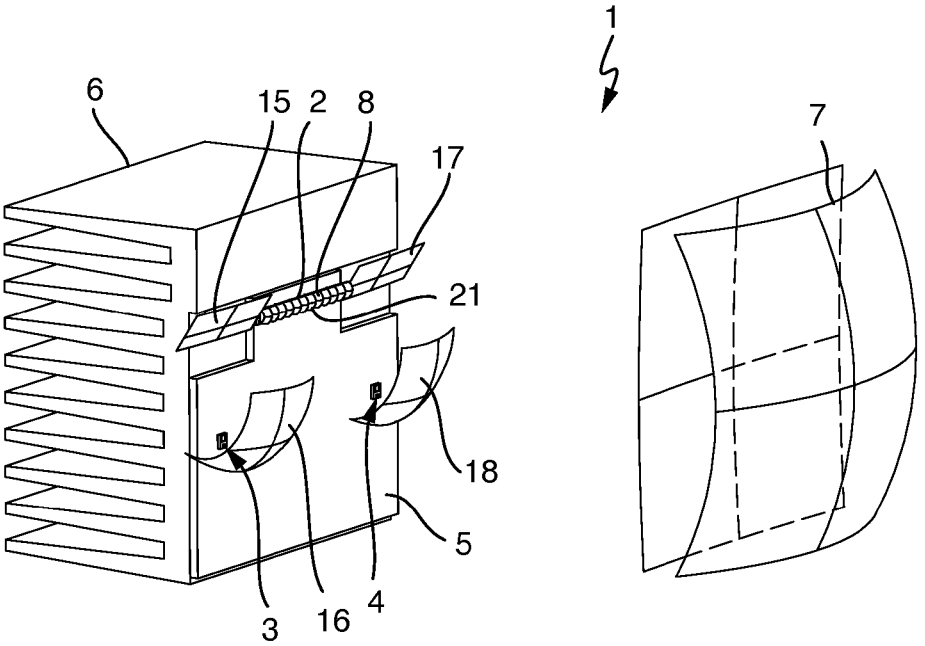
FIG. 1 shows a light module in line with the invention according to a first embodiment.

In FIG. 1, a light module of one embodiment of the invention is depicted with the reference numeral 1. Light module 1 includes at least two light sources for emitting light. In the depicted embodiment, light module 1 includes a first light source 2, which emits light for creating a main light distribution. In the depicted embodiment, light source 2 includes several semiconductor light sources are arranged next to each other, in particular LEDs. The LEDs of light module 2, which are arranged next to each other, are also called a LED-array. It is possible that light source 2 does not only include one row of LEDs, but that the LEDs in light source 2 are arranged in several rows or columns, like in a matrix.

In the depicted embodiment, light module 1 further includes two light sources 3, 4, which send out light for creating a secondary light distribution. Light sources 3, 4 may include one or more semiconductor light sources, in particular LEDs. Several LEDs can be arranged in one row next to each other or matrix-like, next to and above each other. It is also conceivable that light module 1 of the invention could include only one of the light sources 3, 4 or more than the two depicted light sources 3, 4. Light sources 2, 3, 4 of light module 1 are arranged on one circuit board 5. Via circuit board 5, light sources 2, 3, 4 are at least indirectly fixed onto a cooling element 6, which dissipates the heat occurring during the operation of the light sources 2, 3, 4 and which releases it to the surrounding air. In this way, an overheating of the LEDs of the light sources 2, 3, 4 is prevented and a proper operation within the designated temperature window is ensured.

The light sources 2, 3, 4 are assigned to primary optics 8; 15, 16; 17, 18, which focus the light that was sent out from the light sources 2, 3, 4 and that re-direct it onto a secondary optics 7, which projects the light beams onto the roadway in front of the motor vehicle for producing the resulting overall light distribution of light module 1. In this embodiment, primary optics 8 includes an array of converging lenses with several converging lenses that are arranged next to each other in one row. It is conceivable that primary optics 8 could include several primary optics elements (for example, in the shape of converging lenses) arranged in several rows and columns, like in a matrix. Each of the converging lenses is assigned to at least one of the LEDs of light source 2. The converging lenses focus the light that is sent out by the LEDs of light source 2, so that a light output area 21 of the converging lenses is illuminated as evenly and as homogenously as possible. These illuminated areas (the so-called intermediate light distributions) are projected by the secondary optics 7 onto the roadway in front of the vehicle for producing a main light distribution. The primary optics 15, 16 and 17, 18 produce an image of the light sources 3, 4 respectively, which is projected by the subsequent secondary optics 7 onto the roadway in front of the motor vehicle for producing the secondary light distribution.

Thus, secondary optics 7 forms several partial light distributions from these intermediate light distributions and images of the light sources 3, 4, that may be directly connected without any gap or even slightly overlapping, which produce the resulting overall light distribution of light module 1. Secondary optics 7 may include a converging lens and/or a reflector. In the depicted embodiment, secondary optics 7 is designed as a converging lens, as depicted in a schematic way in FIG. 1. Secondary optics 7 may be focused onto the light output areas 21 of the primary optical elements of primary optics 8 or onto a centroid of these light output areas 21.

FIGS. 4 to 7 depict various possibilities for embodiments of primary optics 8 for the main light distribution, wherein A shows a front view, B a top view, C a perspective view, and D a side view of the projection lens 8 respectively.

In the embodiment of FIG. 4, a primary optics 8 is depicted, which includes several plano-convex lenses that are arranged next to each other, as they may be used in light module 1 of FIG. 1. Secondary optics 7 (not depicted in FIG. 4) focuses onto the centroid of the light output area 21 of the array of converging lenses 8. The corresponding focal plane of projection lens 7 is indicated by reference numeral 9. A focal point of projection lens 7 (in the intersection point of the lines AA and BB) is indicated by reference numeral 10. The distance between the central points of two neighboring LEDs of light source 2 or between the optical axes of two neighboring converging lenses of primary optics 8 are referred to as division T. The light that is sent out from the LEDs of light source 2 into a 180° half-space is focused into a light beam 11 with the converging lenses of primary optics 8. The main beam direction of the LEDs, which corresponds to the optical axis of the converging lenses in the depicted embodiment, is indicated by reference numeral 12. The light is focused by the converging lenses in such a way that a particularly homogenous illumination of the light output areas 21 is achieved.

FIG. 5 depicts a primary optics 8, which includes several reflectors arranged next to each other. The reflectors in the depicted embodiment have square cross sections (compare top view in FIG. 5B). The light output areas 21 of the individual reflectors may string together without any gaps and limit the luminous areas with sharp, straight edges. At least one LED of light source 2 is assigned to each reflector of primary optics 8. A (perforated) heat shield 13 may be arranged between the reflector array and the LEDs, which protects the rear side of the reflectors from radiation. Also in this embodiment, the main beam direction of the LEDs corresponds to the optical axis of the reflectors of primary optics 8. Further, the descriptions above regarding FIG. 4 also apply to this embodiment.

In the embodiment of FIG. 6, primary optics 8 for the main light distribution includes several light conductors arranged next to each other. In their longitudinal cut (including the main beam direction of the LEDs; compare FIG. 6A), these have a conical shape with a cross-sectional area, getting bigger from the light input side (facing the LEDs) towards the light output side (facing away from the LEDs). The light conductors may have a square cross section (transverse to the main beam direction of the LEDs; compare FIG. 6B). The light output areas 21 of the individual light conductors may string together without any gaps and limit the luminous areas with sharp, straight edges. At least one LED of light source 2 is assigned to each light conductor of primary optics 8. Further, the descriptions above regarding FIG. 4 also apply to this embodiment.

In the embodiment of FIG. 7, primary optics 8 includes several light conductor slices arranged next to each other. The light output areas 21 of the light conductor slices follow the course of a Petzval field curvature 14 of projection lens 7. In FIG. 7A, division T identifies the distance of the longitudinal axes in the light output areas 21 of two neighboring slices of primary optics 8. In this embodiment, the light emitted from the LEDs of light source 2 is not only focused, but is also deflected on a deflection area 21' which has a convex shape in a vertical cross section (compare FIGS. 7C and 7D).

Referring to FIGS. 4 to 7 and the corresponding descriptions above, the light output areas 21 of the individual elements of primary optics array 8 may be arranged in the focal plane 9 or on the Petzval field curvature 14 of projection lens 7. In this way, secondary optics 7 can be focused onto the light output areas 21 of primary optics 8, or on its centroid.

Referring to FIG. 1, besides light source 2 and the primary optics 8 which is assigned to it for producing a main light distribution, the depicted light module 1 also includes further primary optics assigned to light sources 3, 4, for producing the secondary light distribution. It is intended, that the primary optics, which are assigned to light sources 3, 4, are designed in several parts, in the depicted embodiment in two parts respectively. Thus, a first partial primary optics 15 as well as a second partial primary optics 16 is assigned to light source 3 for the secondary light distribution. Similarly, a first partial primary optics 17 and a second partial primary optics 18 is assigned to the other light source 4 for the secondary light distribution. Although both partial primary optics 15, 16 or 17, 18 are arranged with some distance between them, they jointly fulfill the function of a regular primary optics of a light module 1 which is designed as a projection system.

In the embodiment depicted in FIG. 1, the first partial primary optics 15, which is assigned to light source 3, is designed as a passive mirror and the second partial primary optics 16 is designed as a concave mirror. The same holds true for partial primary optics 16, 18, which are assigned to light source 4, wherein the first partial primary optics 17 is designed as a passive mirror and the second partial primary optics 18 is designed as a concave mirror. The first partial primary optics 15, 17 are arranged on the sides, next to light source 2 for producing the main light distribution or next to the primary optics 8, which is assigned to it or to the light output areas 21 of the primary optical elements. The first primary optics 15, 17 may connect directly and without any gap to primary optics 8 or to their outer light output areas 21. In this way, it is possible to achieve a particularly homogenously illuminated resulting overall light distribution of light module 1 in a simple way, since the images of light sources 3, 4 are arranged tightly next to each other, even without any gap, on the passive mirrors 15, 17 as well as the illuminated light output areas 21 of the individual elements of primary optics 8, so that the illuminated light output areas 21 of the primary optical array 8 or the light source images on the mirror areas of the passive mirrors 15, 17 are projected onto the roadway in front of the motor vehicle with secondary optics 7 in a homogenously illuminated overall light distribution in particular in the transition areas of the partial light distributions.

In the embodiment depicted in FIG. 1, all light sources 2, 3, 4 are arranged and interconnected in one common layer, advantageously on the same circuit board 5. In this way, a particularly simple and cost efficient assembly and interconnection of the light sources 2, 3, 4 is possible. Further, all light sources 2, 3, 4 basically emit light into the same direction (approximately into the direction of secondary optics 7). Specifically, the main beam directions of the individual light sources 2, 3, 4 or of the individual light source elements (LEDs) of light source 2 run essentially parallel to each other.

With the present invention, it is possible to achieve a particularly homogenously illuminated resulting overall light distribution of light module 1, since the areas which create the actual intermediate image (the mirror areas of passive mirrors 15, 17) and the illuminated light output areas 21 of the primary optical elements of primary optics 8 are arranged closely together, even directly bordering to each other. In this way, they can be projected onto the roadway in front of the motor vehicle with secondary optics 7 as an evenly homogenously illuminated resulting overall light distribution. In this connection, "homogenously illuminated" means that the resulting overall light distribution of light module 1, particularly in the transitions between the individual partial light distributions, which are produced onto the roadway by secondary optics 7, displays no undesired dark areas, shadows or dark lines. Yet, a variation of the illuminance distribution within the resulting overall light distribution is possible. It is particularly possible that the luminance distribution of the secondary light distribution decreases towards the outer border of the overall light distribution. It is important, though, that there are no undesired dark areas, shadows or dark lines between the individual partial light distributions, which make up the overall light distribution and which are projected by secondary optics 7.

Furthermore, with the multi-part design of the primary optics 15, 16 or 17, 18, light module 1 of the invention offers a particularly high flexibility and variability regarding the possible arrangement and alignment of the light sources 3, 4 relative to light source 2, and regarding the luminance distribution on the mirror areas of the passive mirrors 15, 17, which means, on the projected areas of primary optics 15, 16 or 17, 18 in the intermediate image projected by secondary optics 7. In this way, it is possible to arrange all light sources 2, 3, 4 of light module 1 in one layer, in particular on one common circuit board 5. This further allows for a particularly flexible configuration of the luminance distribution of the secondary light distribution and thus of the resulting overall light distribution.

Figure 8:
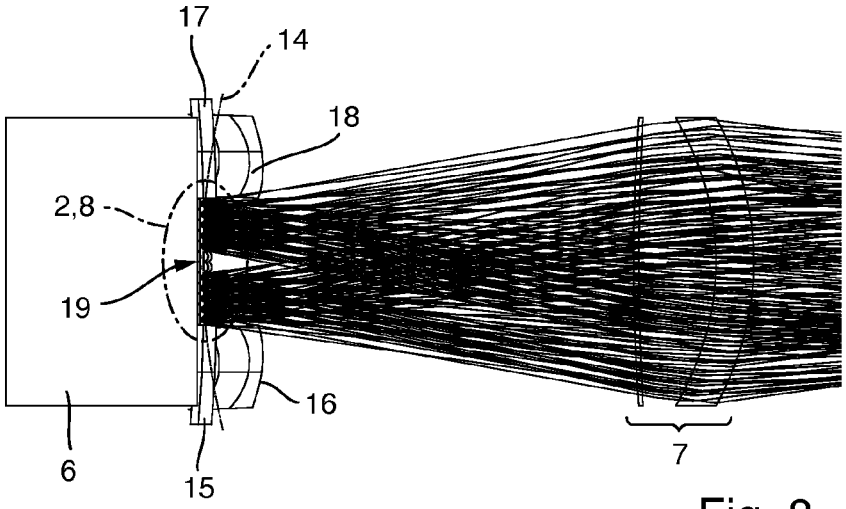
FIG. 8 shows an optical path in the light module in line with the invention at the production of a main light distribution.
Figure 9:
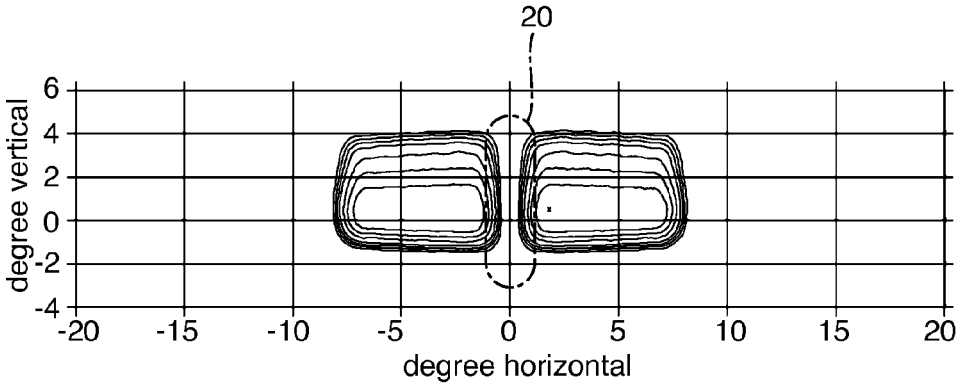
FIG. 9 shows a main light distribution of the light module of FIG. 8 produced on a screen that is arranged in a distance to the light module.
Figure 10:
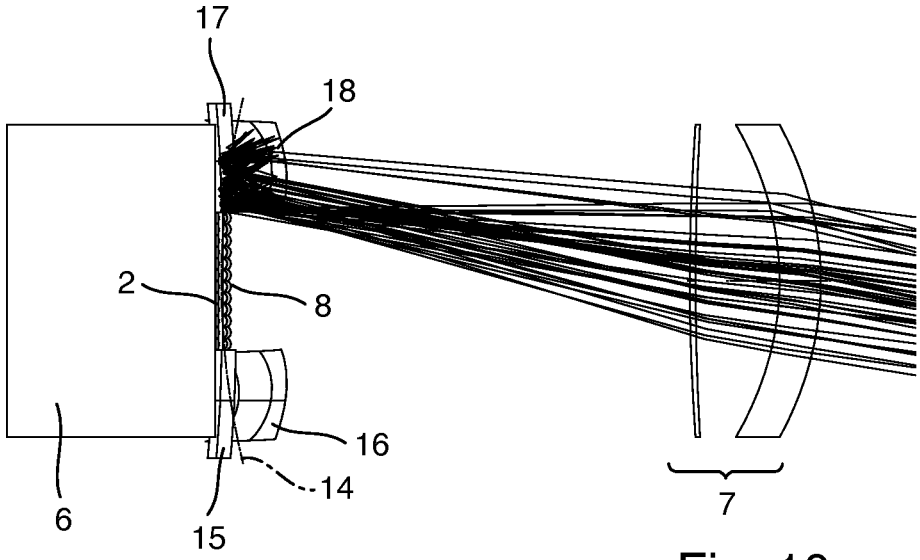
FIG. 10 shows an optical path in the light module in line with the invention at the production of a secondary light distribution.
Figure 11:
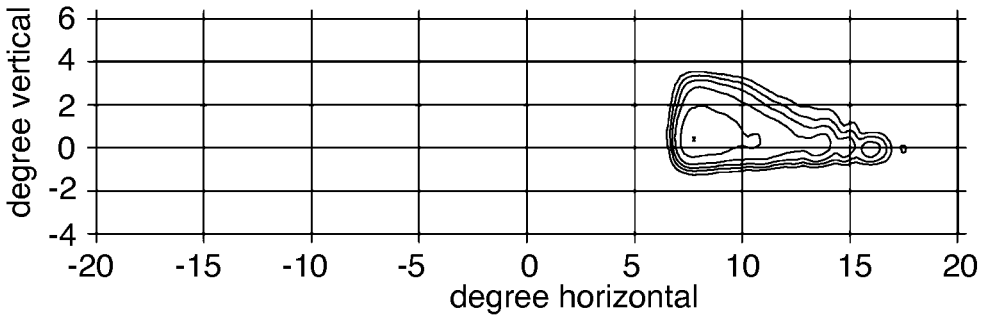
FIG. 11 shows a secondary light distribution of the light module of FIG. 10 produced on a screen that is arranged in a distance to the light module.
Figure 12:
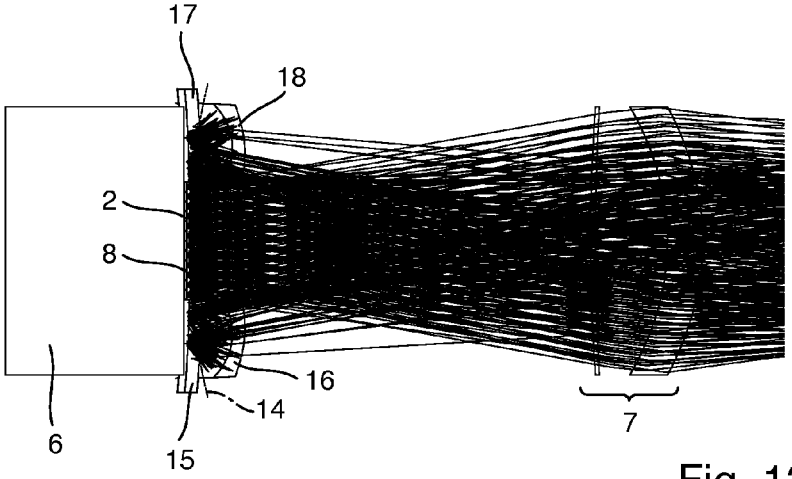
FIG. 12 shows an optical path in the light module in line with the invention at the production of a resulting overall light distribution.
Figure 13:
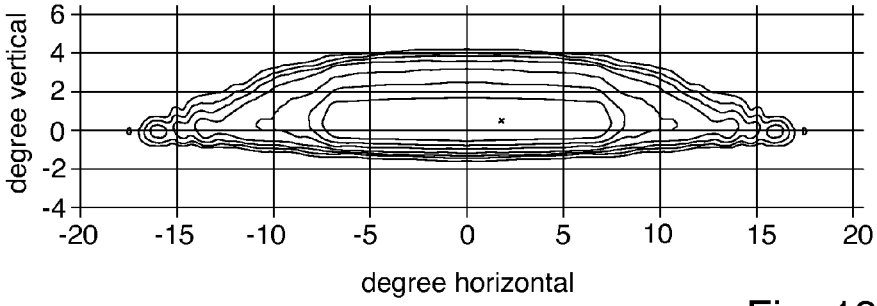
FIG. 13 shows a resulting overall light distribution of the light module of FIG. 12 produced on a screen that is arranged in a distance to the light module.

The different optical paths of light module 1 of FIG. 1 are depicted in FIGS. 8, 10 and 12. The corresponding light distributions on a screen are depicted in FIGS. 9, 11 and 13. The screen is positioned in a defined distance of light module 1. The optical axis of light module 1 may run through the center of the screen, through point HV at 0° horizontal and 0° vertical.

FIG. 8 depicts the optical path when only LEDs of light source 2 are activated, whereby FIG. 8 shows the particular case in which two centrally positioned LEDs of light source 2 are deactivated. The two deactivated LEDs are indicated by reference numeral 19 in FIG. 8. The area of the resulting light distribution, which would generally be illuminated by the two deactivated LEDs 19 (that is, if they were activated), is indicated by reference numeral 20 in FIG. 9. The two deactivated LEDs 19 of light source 2 amount to a non-illuminated area 20 in the center of the light distribution at approximately 0° horizontal with a width of approximately 2° horizontal. The non-illuminated area 20 in the center of the resulting light distribution extends in horizontal direction approximately from −1° to +1°. The height of the non-illuminated area 20 extends over the entire height of the resulting light distribution. Thus, it is possible to specifically deactivate individual LEDs of light source 2 in a matrix head light module in order to fade out an area in the resulting light distribution in front of the motor vehicle, where other traffic participants are located who are driving ahead of the vehicle and/or who are approaching. The varying horizontal positions of other traffic participants (for example, passing or crossing the motor vehicle) and thus the area 20 in the resulting light distribution that is to be cut out, can be accounted for, in that specifically those LEDs 19 are deactivated, which are responsible for illuminating the light for the area 20 that is to be cut out. Alternatively it would also be possible, to deactivate the same LEDs 19 all the time and to move the entire light module 1 or at least parts of it in horizontal direction relative to a housing of the lighting device (for example, to swivel it around a vertical axis) in order to bring the non-illuminated area 20 of the resulting light distribution into congruence with the other vehicles in traffic, which should be faded out of the resulting overall light distribution.

FIG. 10 depicts the optical path of light module 1, wherein only light source 4 is activated for producing a part of the secondary light distribution. The secondary light distribution of light source 4 is a side illumination on the right side next to the main light distribution of FIG. 9. The resulting light distribution of the side illumination on the right side is depicted in FIG. 11. Accordingly, an activation of the other light source 3 would cause a resulting light distribution for producing another part of the secondary light distribution in form of a side illumination on the left. It is possible to activate both light sources 3, 4 at the same time.

The shape and configuration of the resulting side illumination, in particular of the luminance distribution (compare FIG. 11), can be adjusted in a simple and effective way, in that the shape and/or alignment of concave mirror 18 and/or of passive mirror 17 is varied. It is even possible to vary the shape and/or alignment of concave mirror 18 and/or of passive mirror 17 during the operation of light module 1, in order to be able to adaptively adjust the configuration and shape of the resulting side illumination during the operation of the lighting device. In this way it would, for example, be possible to react to present traffic or environmental conditions and to illuminate the border areas on the side more or less brightly.

FIG. 12 depicts the optical path of light module 1 of FIG. 1 of the invention, wherein all light source 2, 3, 4 are activated, including the two LEDs 19, which were still deactivated in FIGS. 8 and 9, as well as light source 3. This results in a particularly homogenously illuminated resulting overall light distribution of light module 1, which is depicted in FIG. 13. The depicted overall light distribution can be a high beam light (if the light distribution would be lowered far enough, so that the upper cut-off line would be located below the horizontal at approximately −1° vertical), a fog light, or a daytime running light (with lowered intensity compared to the high beam light).

Figure 2:
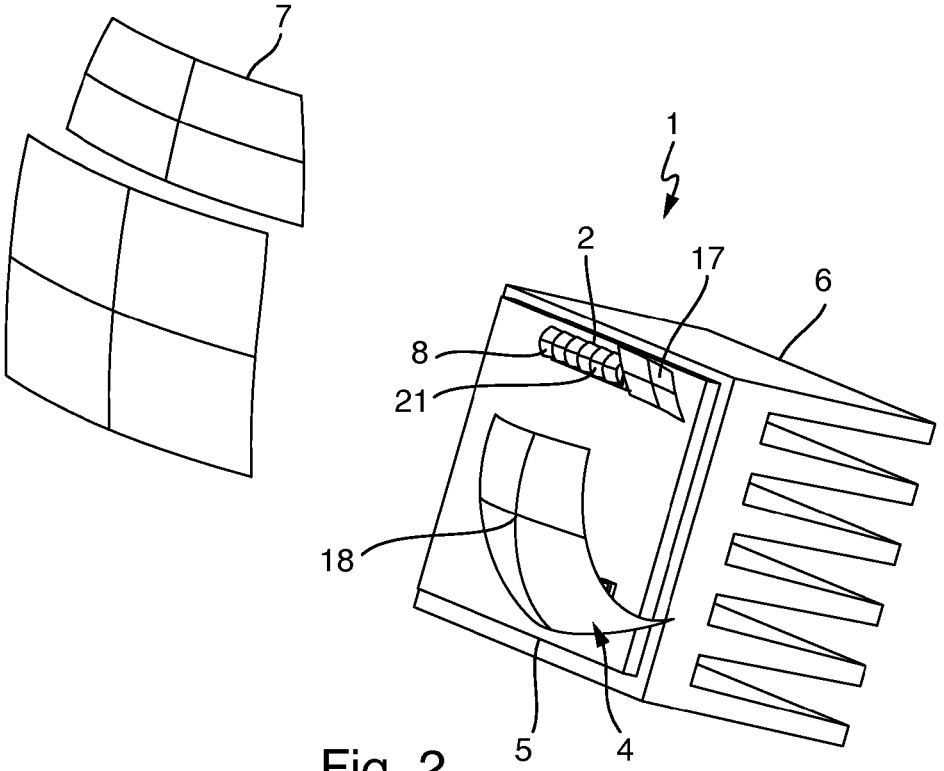
FIG. 2 shows a light module in line with the invention according to a second embodiment.

FIG. 2 depicts a further embodiment of light module 1 according to the invention. Different from light module 1 of FIG. 1, only one light source 4 for producing a secondary light distribution, and accordingly, also only one primary optics 17, 18, which is assigned to it, is intended for it. Furthermore, secondary optics 7 is designed as a faceted paraboloid. The individual facets of a reflector 7 shaped in such a way, and may feature different focal lengths and almost identical back focal lengths towards focal point 10 (compare FIGS. 4B, 5B, 6B).

Figure 3A:
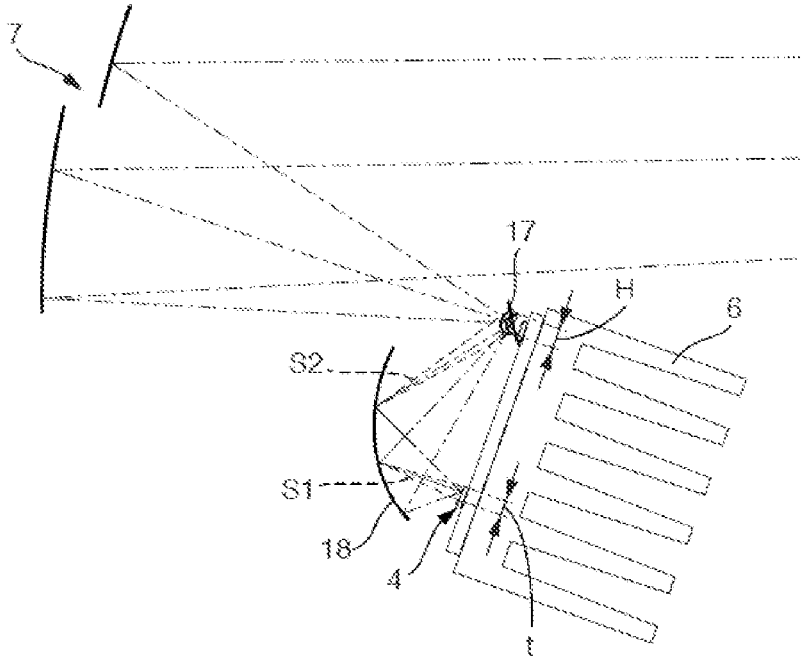
FIG. 3A shows a schematic path of rays in the lighting module according to FIG. 2 in a side view.
Figure 3B:
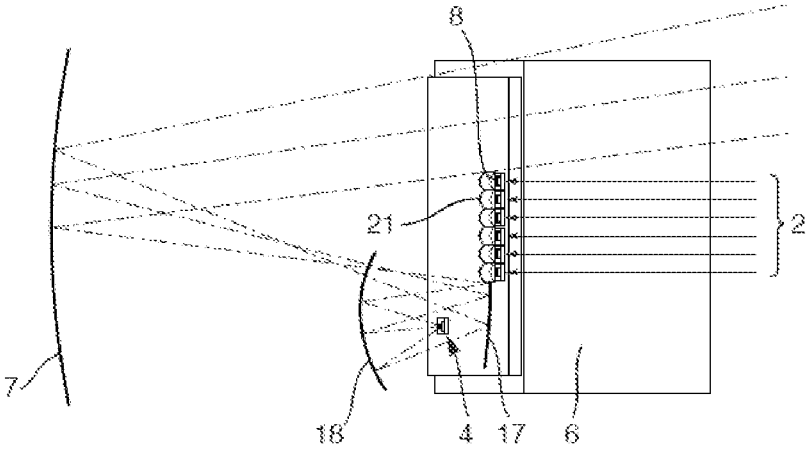
FIG. 3B shows a schematic path of rays in the lighting module according to FIG. 2 in a top view.
Figure 4A:
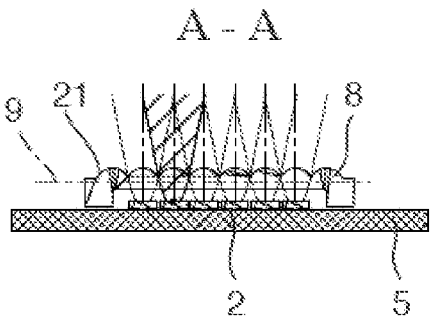
FIG. 4A shows a light source array in combination with a primary optics array for producing a main light distribution of the lighting module according to the present invention according to a first embodiment in a first sectional view along line A-A of FIG. 4B.
Figure 4C:
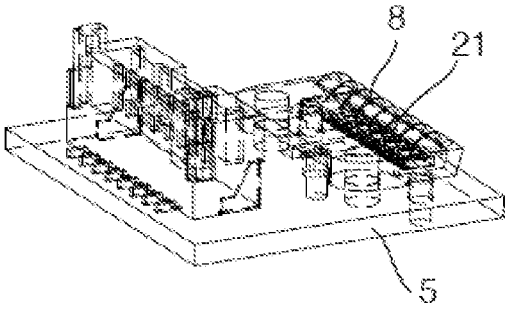
FIG. 4C shows the light source array in combination with a primary optics array for producing a main light distribution of the lighting module according to the present invention according to a first embodiment n a perspective view in part with transparent components for a better view of the overall light source.
Figure 4B:
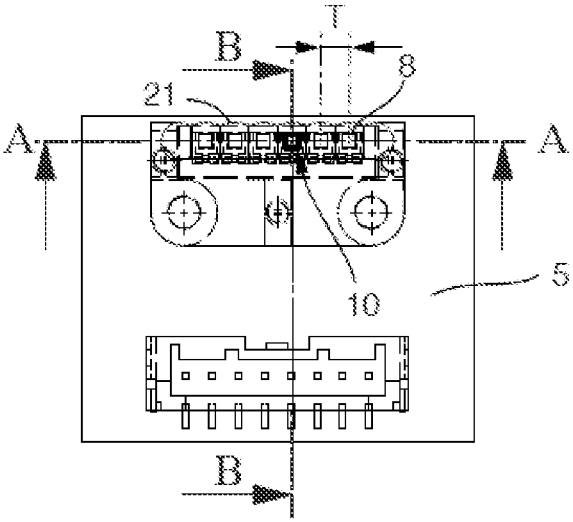
FIG. 4B shows the light source array in combination with a primary optics array for producing a main light distribution of the lighting module according to the present invention according to a first embodiment in a top view.
Figure 4D:
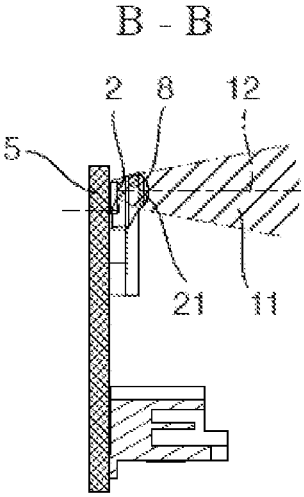
FIG. 4D shows the light source array in combination with a primary optics array for producing a main light distribution of the lighting module according to the present invention according to a first embodiment in a second sectional view along line B-B of FIG. 4B.
Figure 5A:
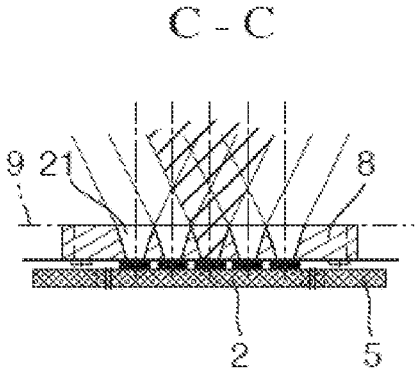
FIG. 5A shows a light source array in combination with a primary optics array for producing a main light distribution of the lighting module according to the present invention according to a second embodiment in a first sectional view along line C-C of FIG. 5B.
Figure 5C:
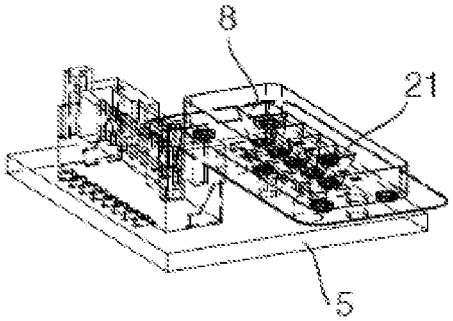
FIG. 5C shows the light source array in combination with a primary optics array for producing a main light distribution of the lighting module according to the present invention according to a second embodiment in a perspective view in part with transparent components for a better view of the overall light source.
Figure 5B:
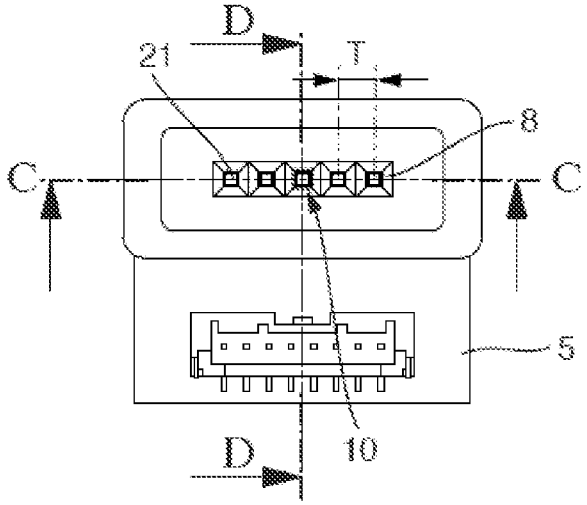
FIG. 5B shows the light source array in combination with a primary optics array for producing a main light distribution of the lighting module according to the present invention according to a second embodiment in a top view.
Figure 5D:
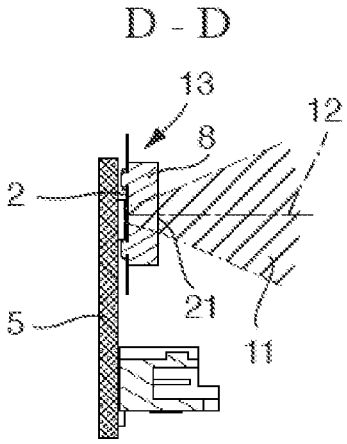
FIG. 5D shows the light source array in combination with a primary optics array for producing a main light distribution of the lighting module according to the present invention according to a second embodiment in a second sectional view along line D-D of FIG. 5B.
Figure 6A:
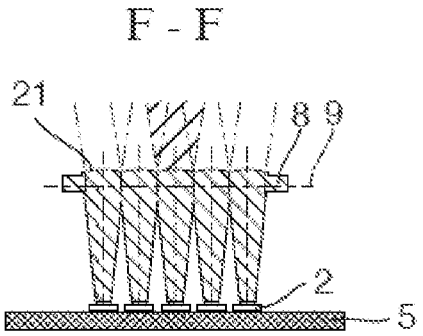
FIG. 6A shows a light source array in combination with a primary optics array for producing a main light distribution of the lighting module according to the present invention according to a third embodiment in a first sectional view along line F-F of FIG. 6B.
Figure 6C:
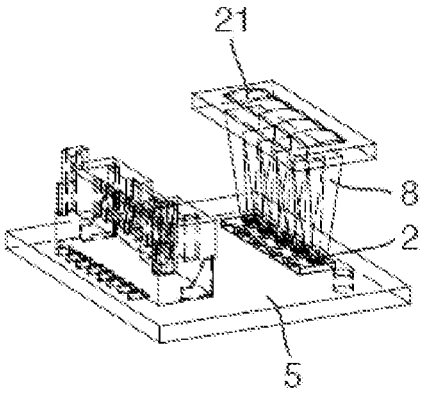
FIG. 6C shows the light source array in combination with a primary optics array for producing a main light distribution of the lighting module according to the present invention according to a third embodiment in a perspective view in part with transparent components for a better view of the overall light source.
Figure 6B:
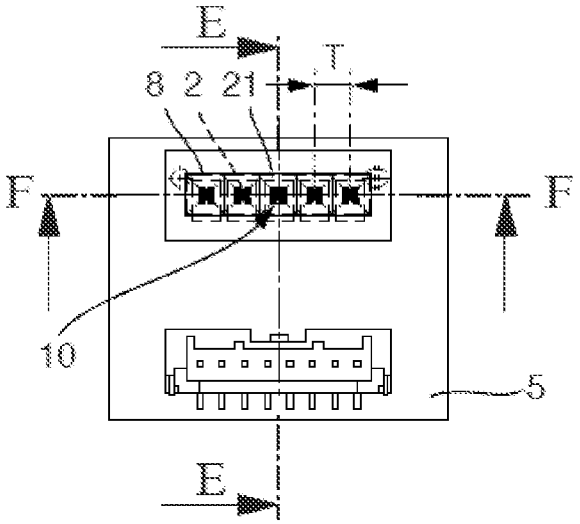
FIG. 6B shows the light source array in combination with a primary optics array for producing a main light distribution of the lighting module according to the present invention according to a third embodiment in a top view.
Figure 6D:
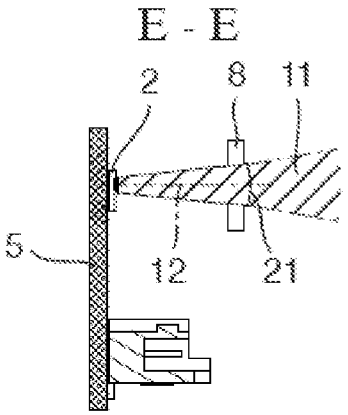
FIG. 6D shows the light source array in combination with a primary optics array for producing a main light distribution of the lighting module according to the present invention according to a third embodiment in a second sectional view along line E-E of FIG. 6B.
Figure 7A:
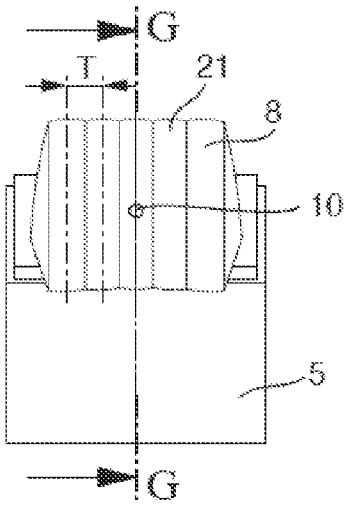
FIG. 7A shows a light source array in combination with a primary optics array for producing a main light distribution of the lighting module according to the present invention according to a fourth embodiment in a front view.
Figure 7C:
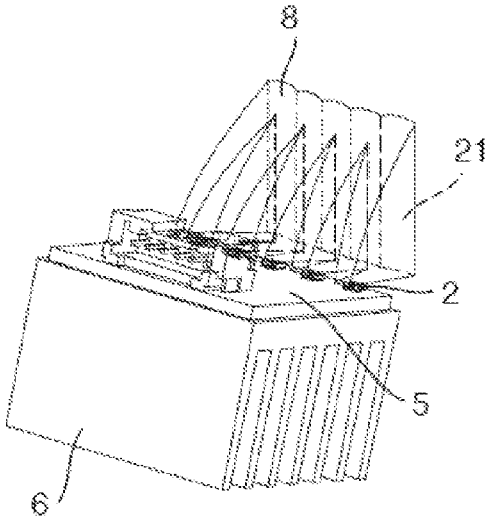
FIG. 7C shows the light source array in combination with a primary optics array for producing a main light distribution of the lighting module according to the present invention according to a fourth embodiment in a perspective view in part with transparent components for a better view of the overall light source.
Figure 7B:
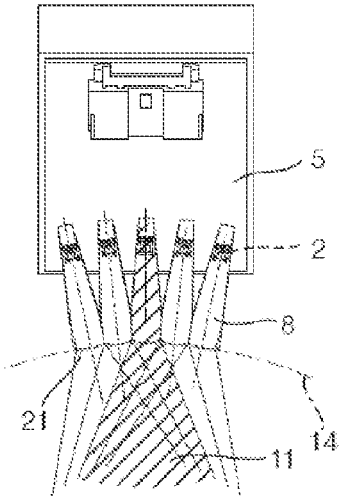
FIG. 7B shows the light source array in combination with a primary optics array for producing a main light distribution of the lighting module according to the present invention according to a fourth embodiment in a top view.
Figure 7D:
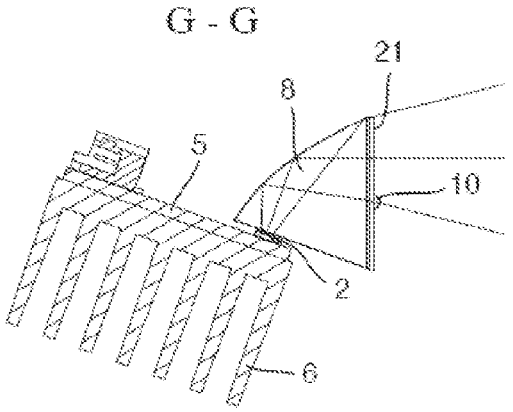
FIG. 7D shows the light source array in combination with a primary optics array for producing a main light distribution of the lighting module according to the present invention according to a fourth embodiment in a sectional view along line G-G of FIG. 7A.

FIG. 3 depicts an optical path in light module 1 of FIG. 2, whereby FIG. 3A displays the vertical optical path and FIG. 3B the horizontal optical path. As shown in the vertical optical path, concave mirror 18 enlarges the LED-chip of light source 4 with an edge length t to at least the height H of the mirror area of passive mirror 17. The magnification M is approximately made up of the ratio of the paths S2/S1. In the horizontal optical path, concave mirror 18 focuses the light for the secondary light distribution onto passive mirror 17, right next to the neighboring primary optical array 8 for the main light distribution. An image of light source 4 results on the mirror area of passive mirror 17. Passive mirror 17 deflects the indecent light onto secondary optics 7, which projects the light source image onto the roadway for producing the secondary light distribution.

Figure 14:
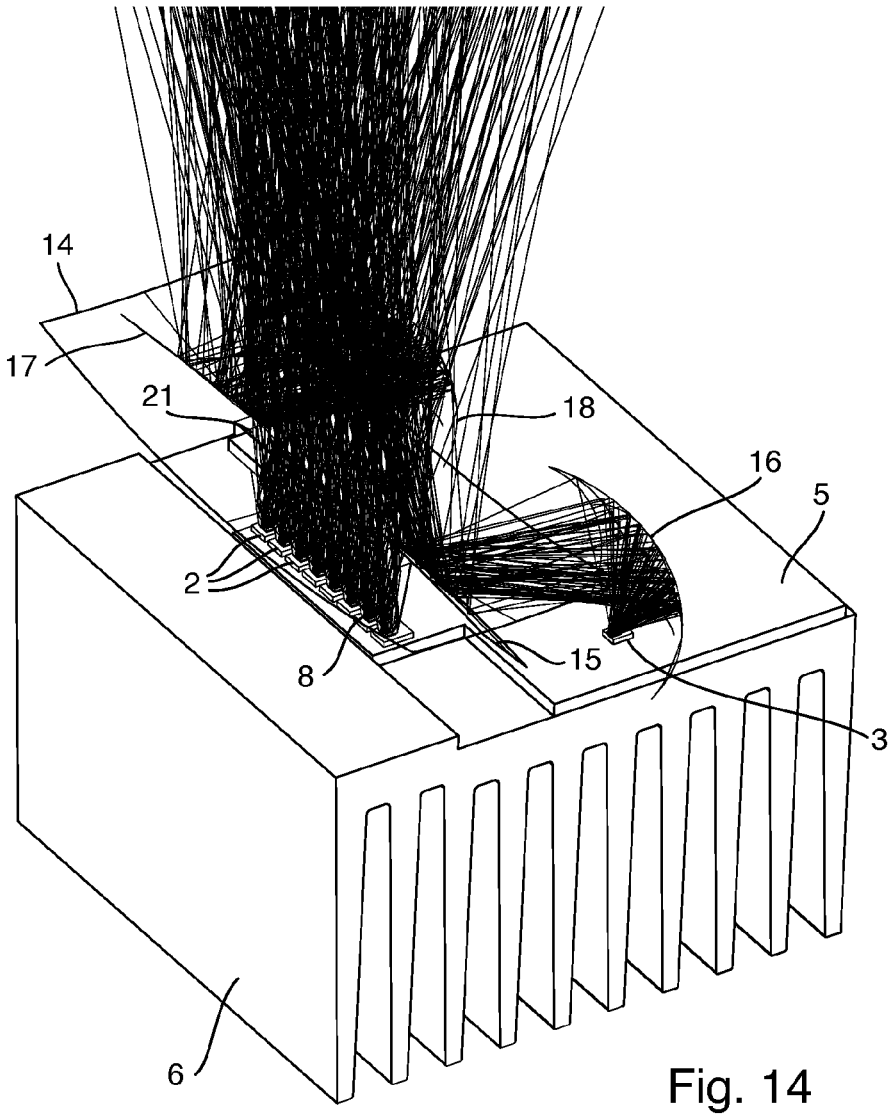
FIG. 14 shows a portion of the light module in line with the invention according to a further embodiment including the optical path for producing the main light distribution as well as the secondary light distribution.

FIG. 14 depicts a further embodiment of light module 1 according to the invention, whereby the depiction of secondary optics 7 is omitted. Primary optics 8 for the main light distribution includes an array made of conical light conductors, whose light output areas 21 are evenly illuminated by the LEDs of light source 2 for the main light distribution (compare FIG. 9). The intermediate light distributions on the light output areas 21 of light conductor array 8 and the light source images on the mirror areas of the passive mirrors 15, 17 are approximately located in the cup-shaped Petzval surface 14, the so-called Petzval field curvature of secondary optics 7.

Figure 15:
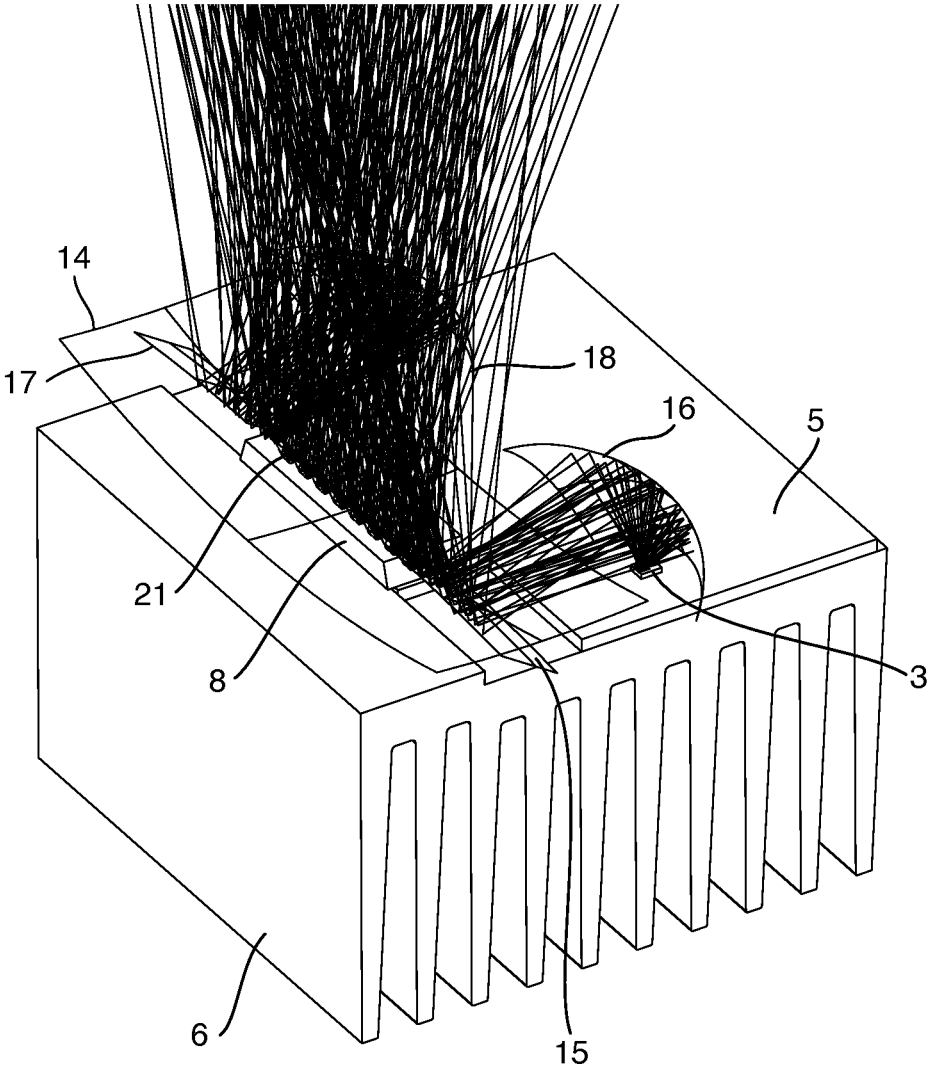
FIG. 15 shows a portion of the light module in line with the invention according to a further embodiment including the optical path for producing the main light distribution as well as the secondary light distribution.

In the embodiment of FIG. 15, primary optics 8 for the main light distribution includes an array of conical reflectors which produce the intermediate light distributions (illuminated light output areas 21) for the main light distribution. The light output areas 21 of reflector array 8 (which means the frontal openings of the individual reflectors towards the light output direction) and the mirror areas of passive mirrors 15, 17 are approximately located in the Petzval field curvature 14 of secondary optics 7.

Figure 16:
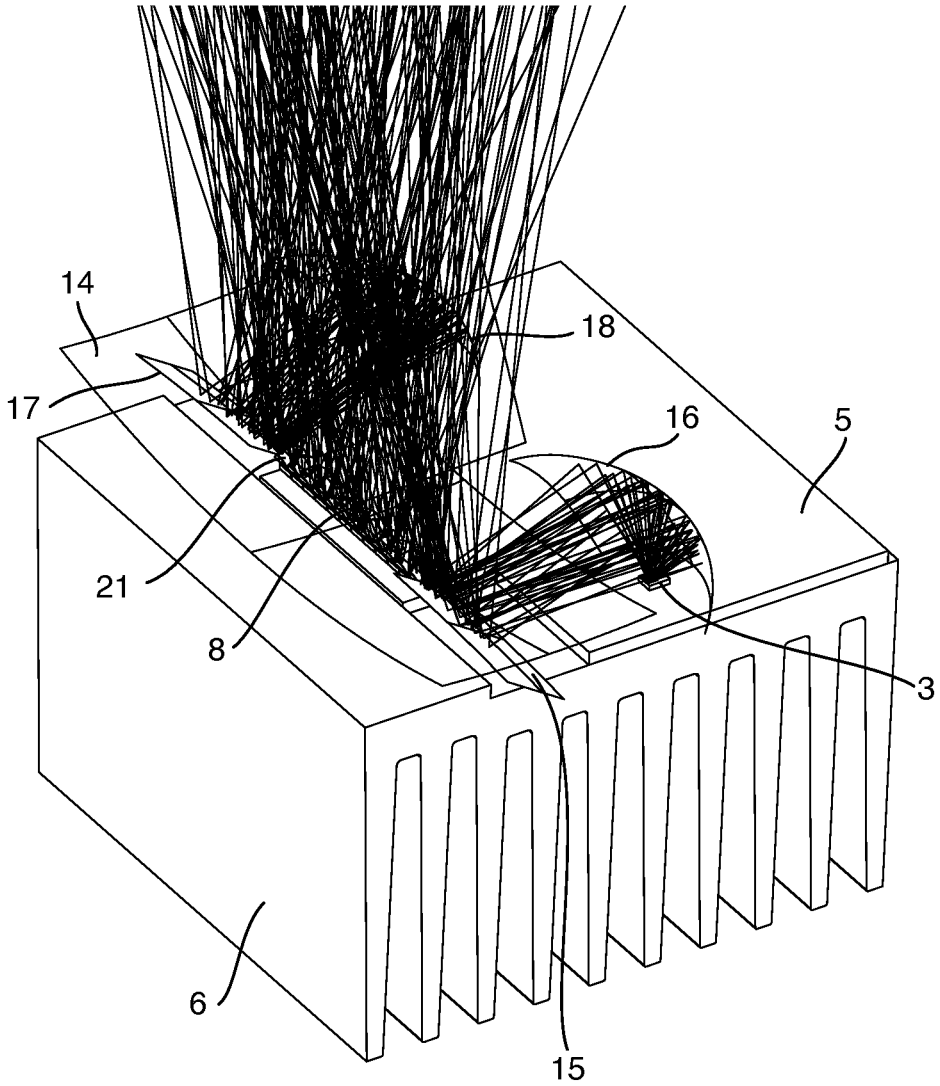
FIG. 16 shows a portion of the light module in line with the invention of FIG. 1 including the optical path for producing the main light distribution as well as the secondary light distribution.

In the embodiment of FIG. 16, primary optics 8 for the main light distribution includes an array of converging lenses which produce the intermediate light distribution for the main light distribution. The light output areas 21 of lens array 8 and the mirror areas of the passive mirrors 15, 17 are approximately located in the cup-shaped Petzval field curvature 14 of secondary optics 7. The Petzval field curvature 14 can be described as an area, where the points are reproduced onto a distant image area in driving direction or in the direction of the beam, in a most even and desired way with secondary optics 7. Here, these object points can also be displayed as lines or rectangles or the like, instead of as points. On a distant image area, far away in front of light module 1 or of the motor vehicle, particularly infinitesimally small zones of secondary optics 7 create equally large and equally aligned images in the intermediate light distributions, which are located in the object sided Petzval field curvature 14 or secondary optics 7. In the angular space, it is possible to displace the individual intermediate light distribution with respect to one another (for example, a blurring of the light distribution in vertical and/or horizontal direction), in particular in vertical direction. In this way, it is possible for example to create strip-shaped, partial light distributions which expand in vertical direction and which fade out softly towards the top and the bottom, from square intermediate light distributions with an even luminance. Here, the optical areas of secondary optics 7 (converging lens or paraboloid) may feature different refractive forces or curvatures in their vertical sections than in their horizontal section.

Rays of light that come from concave mirror 16; 18, but that fail to reach passive mirror 15; 17, do not pass through secondary optics 7 and are therefore not part of the resulting overall light distribution in front of the motor vehicle. Thus, concave mirror 15; 17 limits the secondary light distribution at its borders. Thus, it is possible to first of all produce a wider light distribution as intermediate image with concave mirror 16; 18, and to limit it then with the borders of passive mirror 15; 17. In this way it is possible to compensate positional tolerances within the optical system, so that it is ensured, that the secondary light distribution connects to the main light distribution without any gap. The size of passive mirror 15; 17 may be selected in such a way that light source 3; 4 for the secondary light distribution is enlarged with concave mirror 16; 18 and passive mirror 15; 17 at least to a light source image which reaches the size of light output area 21 of the neighboring primary optics 8. In order to compensate production and to material tolerances, it is suggested to select a little higher magnification. If primary optics 8 for the main light distribution has the height H, and a square LED-chip of light source 3; 4 for the secondary light distribution features an edge length of t, the magnification of concave mirror 16; 18 can be selected, for example, with M=H/t, or larger. The following relation applies with reference to FIG. 3 and the associated description in particular:

$$M=1 \ldots 1.5\times H/t=1 \ldots 1.5\times S2/S1$$

Distance S1 begins in the center of light source 3; 4 for the secondary light distribution and propagates in the main direction of the beam of light source 3; 4, with LEDs in particular perpendicular to the LED-chip. Distance S1 ends with reaching the reflection area of concave mirror 16; 18. At this point, distance S2 begins and reaches into the direction of passive mirror 15; 17, preferably towards the center of the concave mirror. The passive mirror 15; 17 may be positioned (for the secondary light distribution or its mirror area and the primary optical array 8 for the main light distribution or its light output areas 21) as precisely and as closely next to each other, so that also the intermediate light distributions or the light source images of the main and secondary light distribution possibly connect without any gap after their projection with secondary optics 7 in the resulting overall light distribution. This can be accomplished in that both elements (passive mirror 15; 17 and primary optics 8) are designed in one piece.

The invention has been described in an illustrative manner. It is to be understood that the terminology which has been used is intended to be in the nature of words of description rather than of limitation. Many modifications and variations of the invention are possible in light of the above teachings. Therefore, within the scope of the appended claims, the invention may be practiced other than as specifically described.

What is claimed is:

1. A light module of a lighting device in a motor vehicle comprising: at least two light sources for emitting light in a main direction; at least two primary optics which are assigned to the light sources, for focusing at least a portion of the emitted light and wherein said light sources are arranged on one common plane that is perpendicular to the main direction of emitted light and on one common circuit board, whereby at least one light source is assigned to one of the primary optics respectively; and a common secondary optics in order to form several light distributions, which are directly joined to each other or which have an overlapping area, from at least some of the light beams produced by the primary optics, wherein at least one of the light sources is equipped to produce light to create a main light distribution, and at least one other light source is equipped to create a secondary light distribution, whereby the main light distribution is used to illuminate a center of the resulting overall light distribution of the light module and the secondary light distribution is used for illuminating at least one border area next to the main light distribution, and the primary optics which is assigned to at least one of the light sources for producing light for the secondary light distribution, is arranged in several parts, wherein at least one first partial primary optics in the form of a passive mirror is arranged next to at least one of the primary optics which is assigned to the at least one of the light sources for producing light for the main light distribution, wherein images of the at least one other light source for producing light for the secondary light distribution are produced on the at least one passive mirror and individual light output areas of the primary optics which are assigned to the at least one of the light sources for producing light for the main light distribution are illuminated by the at least one of the light sources, and wherein at least one second partial primary optics in the form of a concave mirror is arranged next to the at least one other light source in order to reflect light emitted by the at least one other light source and to direct it onto the first partial primary optics.

2. The light module (1) according to claim 1, as set forth in claim 1, wherein the primary optics are designed and aligned in such a way, that the intermediate light distributions, that are produced by the primary optics on their light output areas, which will be projected in front of the motor vehicle by the secondary optics for producing a resulting overall light distribution of the light module are located next to each other.

3. The light module as set forth in claim 2, wherein the intermediate light distributions are bordering each other without any gap.

4. The light module as set forth in claim 2, wherein the intermediate light distributions are at least partially located in one focal plane of the secondary optics.

5. The light module as set forth in claim 2, wherein the intermediate light distributions are at least partially located in one Petzval field curvature of the secondary optics.

6. The light module as set forth in claim 1, wherein at least one of the other partial primary optics is arranged in the vicinity of the at least one light source for producing the secondary light distribution, and that it is configured in such a way that it deflects the light that is sent out from this light source onto the at least one of the first partial primary optics.

7. The light module as set forth in claim 6, wherein at least one of the other partial primary optics is designed as a concave mirror.

8. The light module as set forth in claim 1, wherein at least one first of the partial primary optics is designed as a passive mirror and that it is configured in such a way, that it deflects the light, which was deflected by the at least one other partial primary optics into the direction of secondary optics.

9. The light module as set forth in claim 8, wherein one of the shape and alignment of the passive mirror is variable during operation of the light module.

10. The light module as set forth in claim 1, wherein at least one first of the partial primary optics is directly connected without any gap to the at least one primary optics which is assigned to the light source for producing the light for the main light distribution.

11. The light module as set forth in claim 8, wherein at least one of the other partial primary optics is designed and arranged in such a way into the light module, that the light which is deflected from the at least one of the other partial primary optics onto the passive mirrors illuminates the entire reflecting area of the passive mirror.

12. The light module as set forth in claim 1, wherein at least one first of the partial primary optics is arranged on two opposing sides respectively, next to the at least one primary optics which is assigned to the light source for producing light for the main light distribution.

13. A lighting device in a motor vehicle with a light module as set forth in claim 1.

* * * * *